United States Patent [19]

Roznieckí

[11] Patent Number: 4,500,254

[45] Date of Patent: Feb. 19, 1985

[54] GAS EXPANSION MOTOR

[76] Inventor: Edward J. Roznieckí, 31041 Angeline, St. Clair Shores, Mich. 48082

[21] Appl. No.: 439,665

[22] Filed: Nov. 8, 1982

[51] Int. Cl.[3] ..... F01D 5/00

[52] U.S. Cl. ..... 415/75

[58] Field of Search ..... 415/71, 72, 73, 75, 415/76, 215; 366/89, 266, 323; 384/107, 111

[56] References Cited

U.S. PATENT DOCUMENTS

| | | | |
|---|---|---|---|
| 158,579 | 1/1875 | Fairfax | 415/76 |
| 1,064,824 | 6/1913 | Fledderjohan | 415/76 U X |
| 1,136,957 | 4/1915 | Hettinger | 415/72 |
| 2,404,371 | 7/1946 | Glaser | 415/75 |
| 2,544,154 | 3/1951 | Hampton | 415/73 |
| 2,808,225 | 10/1957 | Johnson | 415/72 U X |
| 3,311,363 | 3/1967 | Phillips et al. | 366/323 X |
| 3,326,453 | 6/1967 | Kun | 384/107 |
| 3,609,058 | 9/1971 | Tarsoly | 415/72 X |
| 3,697,190 | 10/1972 | Haentjens | 415/72 U X |
| 3,771,900 | 11/1973 | Baehr | 415/72 |

FOREIGN PATENT DOCUMENTS

| | | | |
|---|---|---|---|
| 560337 | 10/1923 | France | 415/72 |
| 710725 | 8/1931 | France | 415/72 |
| 1831 | 1/1907 | United Kingdom | 415/76 |

*Primary Examiner*—Abraham Hershkovitz
*Assistant Examiner*—Joseph M. Pitko
*Attorney, Agent, or Firm*—Peter A. Taucher; John E. McRae; Robert P. Gibson

[57] ABSTRACT

A gas-operated motor that comprises a divergent nozzle helically wrapped around a rotary support shaft to convey gas from a high pressure inlet chamber to a low pressure outlet chamber. The gas is progressively depressurized during its flow along the nozzle passage; pressure energy is converted to a turning force on the shaft. The structure represents a relatively simple, low cost mechanism for converting gas pressure energy into high speed rotary motion.

3 Claims, 7 Drawing Figures

GAS EXPANSION MOTOR

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to a motor that is operated by controlled expansion of a pressurized gas. The motor includes a rotor that has a helical screw configuration for conveying pressurized gas from an inlet chamber to an outlet chamber. The helical passage defined by the screw has a progressively increasing cross section, measured from the inlet to the outlet, whereby the gas expands as it travels along the passage. Expansion of the gas produces rotary motion of the rotor.

A principal aim of the invention is to provide a gas expansion motor that has a relatively small diameter, thus reducing the need for precise dynamic balancing of the rotor. Another aim of the invention is to provide a gas expansion motor wherein the rate of gas expansion is controlled by the rotor passage configuration. A further aim of the invention is to provide a motor wherein the gas can expand from a relatively high pressure to a relatively low pressure (near atmospheric) in a single turbine stage. An important object of my invention is to provide a gas expansion motor which operates with a minimum of turbulence and pressure loss. A general object of the invention is to provide a gas expansion motor that can be manufactured at relatively low cost.

THE DRAWINGS

Figure 7:
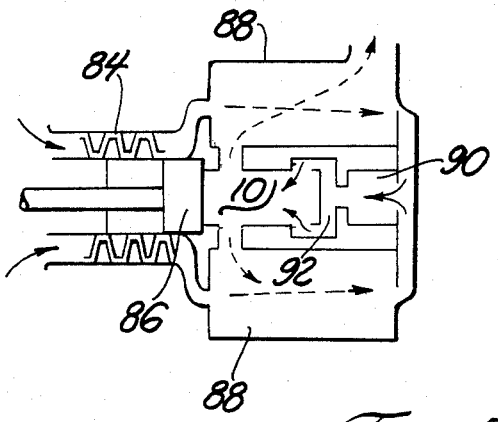

FIG. 7 diagrammatically illustrates a vehicle power plant adapted to use my improved motor.

Figure 1:
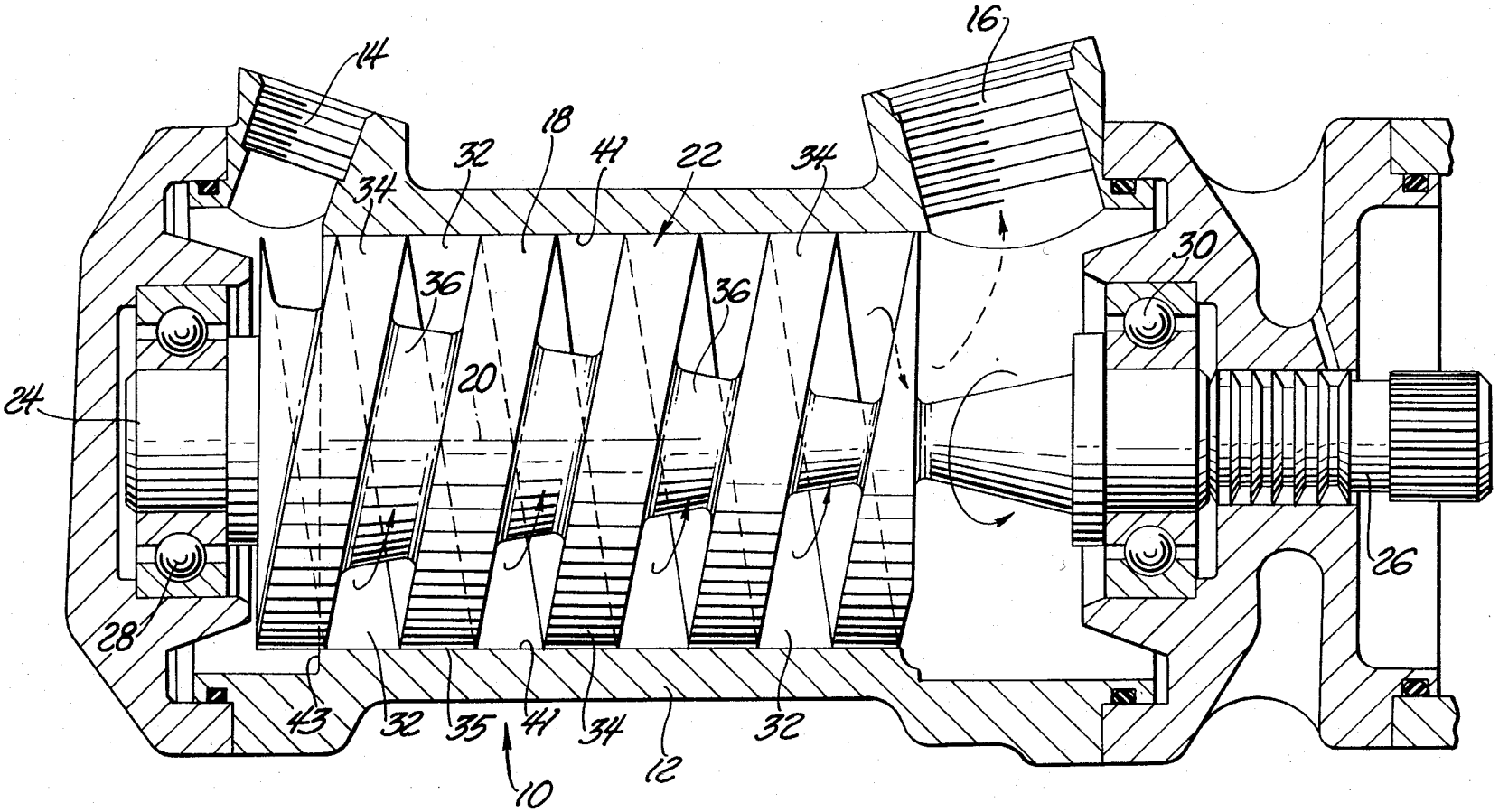
FIGS. 1 through 5 are longitudinal sectional views through five different embodiments of my invention.

As shown in FIG. 1, my invention comprises a gas expansion motor 10 that includes a housing 12 defining an inlet 14 for receiving pressurized gas from a non-illustrated pressure source, and an outlet 16 for discharging spent gas in a depressurized state. A rotor 18 is disposed in housing 12 for rotation around its geommetrical axis 20. The motor comprises a central helical screw-like member 22, and two shaft sections 24 and 26 extending from the ends of member 22. Anti-friction bearings 28 and 30 engage the shaft sections to support the rotor for high speed rotation around axis 20. Shaft 26 extends beyond the motor housing for connection to a non-illustrated power-using device, such as an automotive transmission, step-down gear box, electric generator, pump, etc.

The gas pressure at inlet 14 is appreciably higher than at outlet 16. Helical passage 32 defined by the helical wall 34 has a gradually increasing cross section for enabling the gas to gradually depressurize and expand as it proceeds through the passage. The change in passage cross section is achieved by tapering the central shaft area 36 in a left-to-right direction. Expansion of the gas resulting from progressive increase in passage area produces rotation of rotor 22 in a direction opposite to the direction taken by the gas; e.g. if the gas motion is counterclockwise the rotor motion will be clockwise.

The length of helical passage 32 is preselected to maximize the gas expansion taking place in the passage. Passage design follows design practices used for exit nozzles of rocket engines operating just below the sonic flow range. Passage 32 may be visualized as being similar to a large ratio expansion nozzle wrapped in helical fashion around a support shaft. The linear thrust that would be achieved in a rocket engine is instead realized as turning torque on rotor 22. I contemplate that in practice a relatively long helical passage 32 will be used (at least four passage convolutions) to achieve large expansion ratios, as high as fifty. The term expansion ratio is here used to mean the ratio of the passage transverse cross section at the right end of the rotor compared to the passage transverse cross section at the left end of the rotor. Rate of change of the passage cross section is selected to minimize fluid separation (or over-expansion) within the passage.

Figure 2:
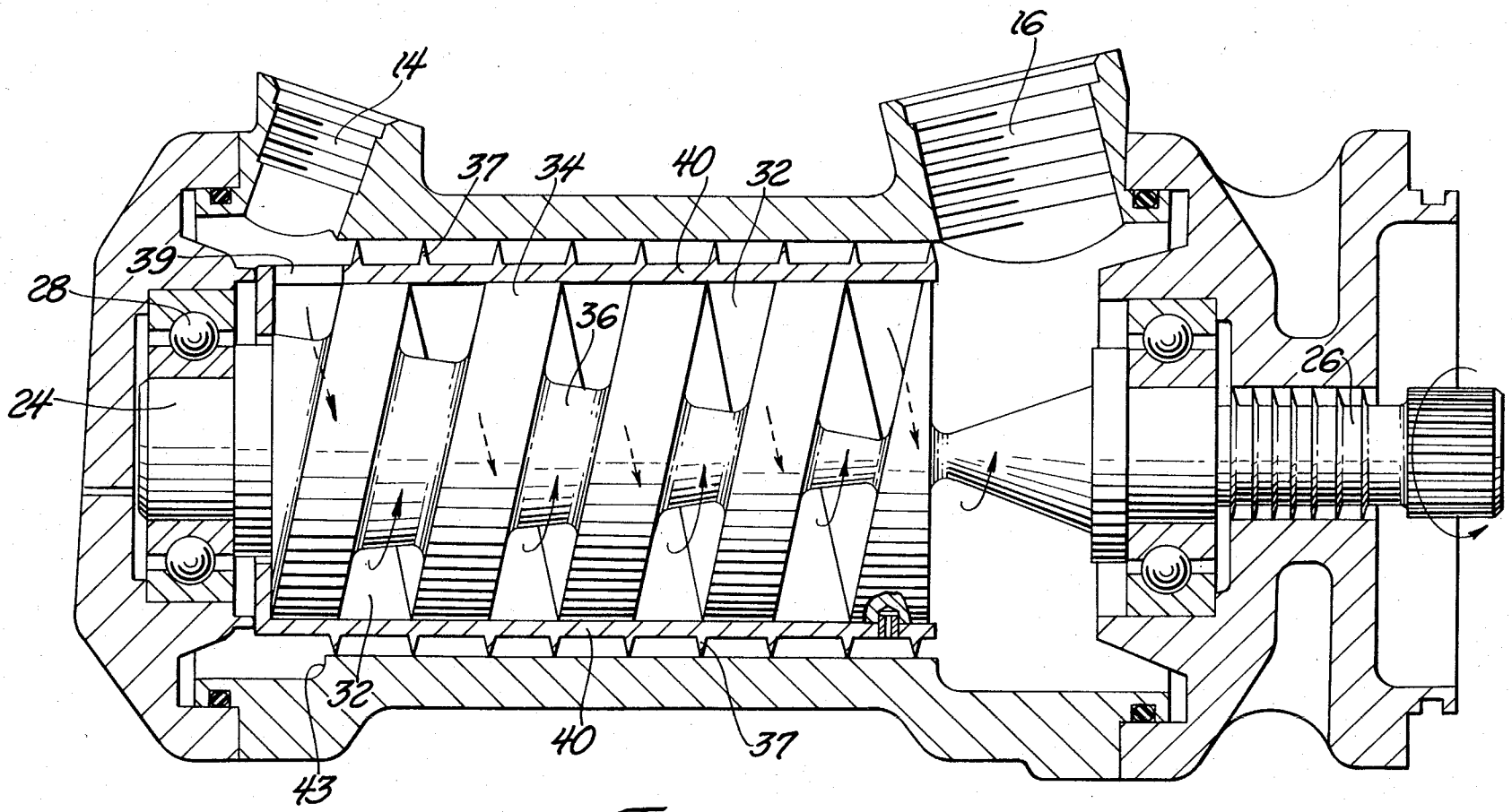

FIG. 1 represents the basic concept. A preferred embodiment of the invention is shown in FIG. 2, wherein the rotor includes an annular shroud 40 suitably attached to the outer edge areas of the helical wall 34. Pressurized gas within inlet chamber 14 is admitted to helical passage 32 via a port 39 in shroud 40; the housing is constructed so that port 39 communicates with inlet 14 in any rotated position of the rotor. One advantage of the shrouded rotor, compared to the FIG. 1 unshrouded rotor, is that the gas is effective for rotor turning purposes immediately as it passes through port 39; in the FIG. 1 version the gas is believed to be fully effective only after it is confined by housing wall surface 41, i.e, after it passes rightwardly beyond housing shoulder 43. The FIG. 2 rotor can be somewhat shorter than the FIG. 1 rotor for a given gas expansion and rotor turn force.

A principal advantage of shroud 40 is that it prevents the mechanical power loss that might otherwise occur due to fluid leakage across the peripheral edge of the helical wall (FIG. 1). Any leakage across peripheral edge 35 of wall 34 in FIG. 1 results in a power loss, whereas a corresponding leakage across the labyrinth seal 37 in FIG. 2 has no effect on the mechanical power output. Of course, in both cases the leakage will increase gas consumption.

Figure 3:
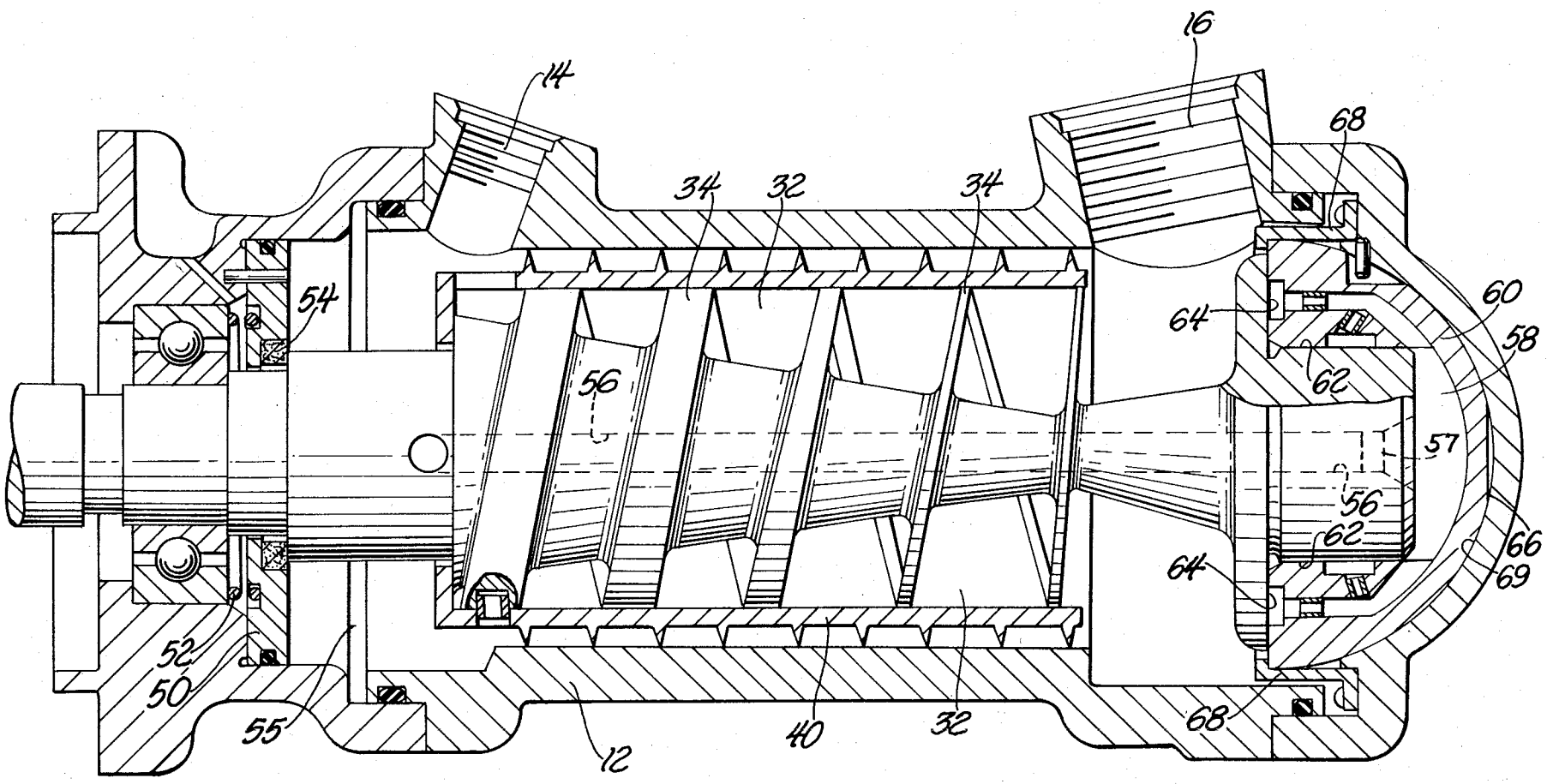

The FIG. 3 structure is generally similar to the FIG. 2 structure. However, in the FIG. 3 embodiment helical wall 34 has a gradually decreasing transverse cross section, measured in a left-to-right direction. Therefore the helical passage 32 experiences a cross section increase in two different directions, i.e., radially and axially. The FIG. 3 structure achieves a greater rate of passage 32 cross-section increase than the FIG. 2 structure for a given rotor size. Actual testing may prove the FIG. 3 version to be the most practical approach to most frequency encountered situations. FIG. 3 also illustrates bearing features that may prove desirable to meet special circumstances, especially high rotational speed requirements.

The left bearing in the FIG. 3 structure is equipped with a seal plate 50 having a spring 52 for biasing the plate against a shoulder on the rotor shaft. The seal element takes the form of a carbon ring 54. The rightmost bearing is an air bearing having an automatic alignment feature. Pressurized filtered air flows from chamber 55 through an axial passage 56 to a chamber 58 within a bearing element 60; a filter element 57 is indicated at the right end of passage 56 to insure performance of the air bearing. Branch passages direct the pressurized air from chamber 58 into annular spaces exposed to radial bearing suface 62 and thrust bearing surface 64. The outer surface 66 of element 60 slidably seats against spherical housing surface 69 to enable the bearing to readily adjust to the exact attitude of shaft 26. A spring retainer means 68 keeps element 60 within its spherical seat 69. Use of air bearings is considered desirable for very high rotor speed situations, e.g. above 100,000 r.p.m..

Figure 4:
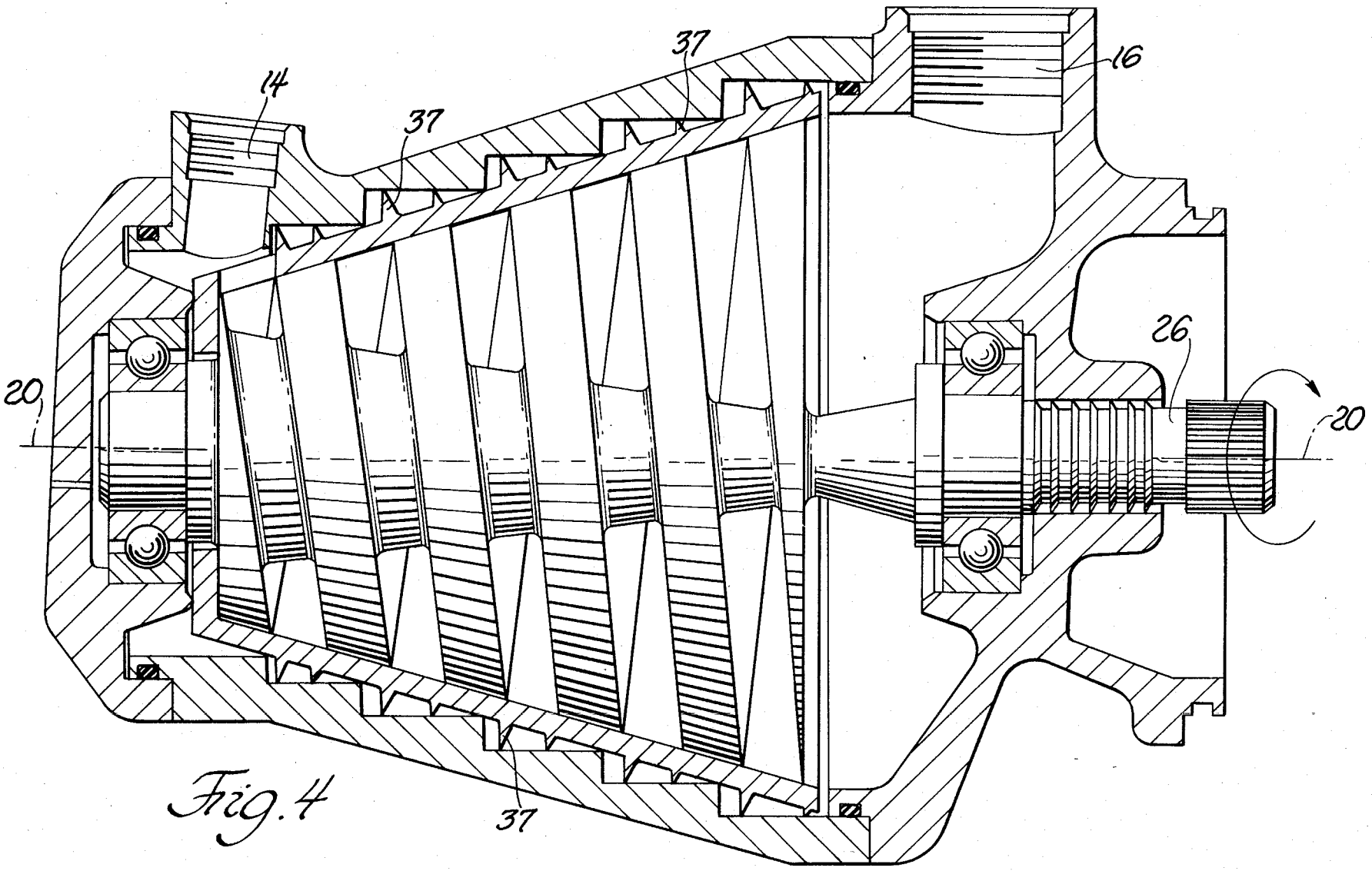

The FIG. 4 embodiment is similar to the FIG. 2 embodiment except that the shroud has a frust-conical configuration; the rotor diameter progressively increases from the inlet end of the rotor to the outlet end. With such an arrangement the helical gas passage experiences a relatively great change in cross section, measured along the length of the passage. The housing internal surface may be stepped to provide a more tortuous path for fluid otherwise tending to leak through the seal elements 37 carried by the shroud wall.

Figure 5:
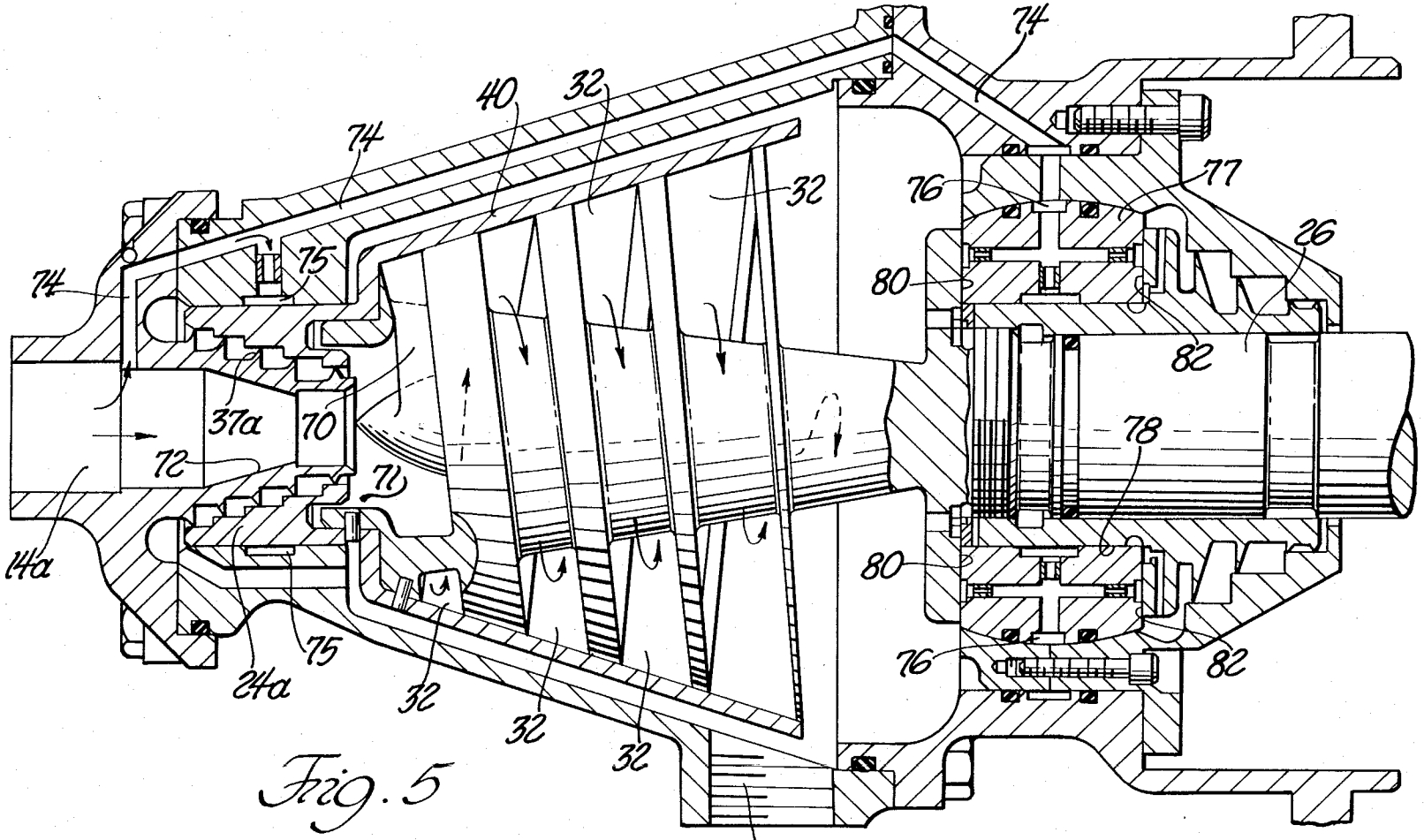

FIG. 5 illustrates a form of the invention designed to include an axial gas inlet. Pressurized gas flows through axial inlet 14*a* into a chamber 71 formed in the nose of the rotor. A turning vane 70 within chamber 71 causes the gas to be rotated out of the plane of the paper and thence into the helical passage 32 on the rotor periphery. After its travel through passage 32 the now-depressurized gas exits through outlet 16. Shroud 40 includes an annular shaft section 24*a* whose internal surface engages seal elements 37*a* carried by a fixed annular wall 72.

The FIG. 5 structure includes air bearings for the shaft sections 24*a* and 26. Pressurized air flows from inlet 14*a* through a branch passage 74; part of the passage 74 air is supplied to an annular chamber 75 surrounding shaft section 24*a*. Part of the passage 74 air is supplied to an annular chamber 76 formed in the spherical surface of shaft-support member 77. A system of passages in member 77 directs the air into three annular chambers communicating with radial bearing surface 78 and thrust bearing surfaces 80 and 82. The FIG. 5 rotor includes the tapering shaft feature of FIGS. 1 through 4, the shroud feature of FIGS. 2 through 4, the helical wall taper feature of FIG. 3, and the shroud frusto-conical configuration of FIG. 4.

Figure 6:
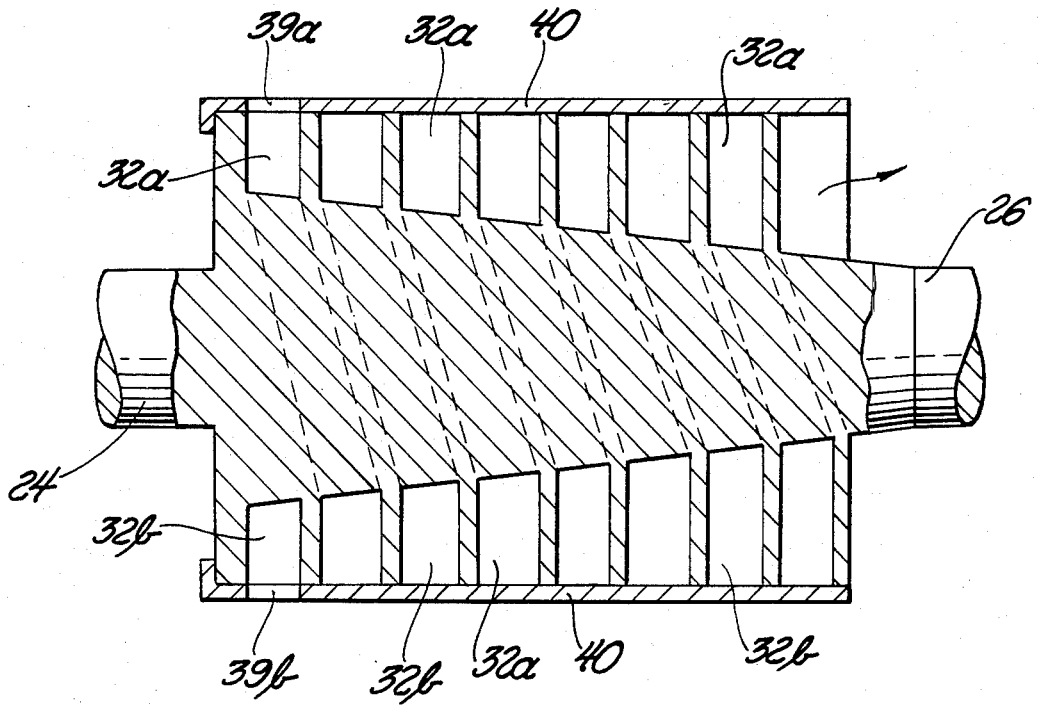
FIG. 6 is a fragmentary sectional view through a rotor element usable in the FIG. 2 embodiment.

FIG. 6 illustrates a rotor construction that may be used as a substitute for the rotor shown in FIG. 2. The principal feature of interest relative to FIG. 6 is the fact that the rotor is built to define two helical passages 32*a* and 32*b* instead of one helical passage. Annular shroud 40 is provided with two intake ports 39*a* and 39*b* for admitting pressurized gas to respective ones of passages 32*a* and 32*b*. The only perceived advantage of using two (or more) helical passages is a possible capability for complete filling of each passage (large gulp factor) at very high rotational speeds, e.g. above 200,000 r.p.m.

I believe the gas expansion motor designs shown in FIGS. 1 through 6 are usable in varying sizes and pressure ranges to suit different situations where a relatively small diameter structure is desired. Illustratively, FIG. 7 shows a vehicle propulsion system wherein my improved motor 10 is disposed to drive an axial flow compressor 84 through a step-down gear box 86. The compressed gas is passed through the cool side of an annular regenerator (heat exchanger) 88. The heated gas combusts diesel fuel in a can-type combustor 90. Highly pressurized combustion products are passed into passage 92, thence into motor 10 for powering the rotor (not shown in FIG. 7). Low pressure gas is exhausted from motor 10 through the hot side of the regenerator, and thence to the atmosphere. Motor 10 is a relatively small diameter, high speed device suitable for meeting various situations where small size is important, as in the FIG. 7 vehicle propulsion environment.

The screw-like rotor design is believed to be advantageous in that the gas expansion rate is controlled by a single continuous helical passage spanning at least four helical convolutions. Flow losses (turbulence or separation) are believed to be relatively low with this design. Another possible advantage is low manufacturing cost; it is believed that the single rotor design can be manufactured more cheaply than conventional multi-stage axial flow turbine designs. Since my rotor has a relatively small diameter it can operate at very high rotational speeds, e.g. above 200,000 r.p.m., without the centrifugal explosive failure that can occur with conventional large diameter axial flow designs.

I known of no prior art design corresponding to my present invention. U.S. Pat. No. 1,136,957 issued in the name of C. Hettinger shows a screw-like rotor device, which the patentee indicates can achieve a gas-compressing function. I do not believe the Hettinger design can in fact achieve a gas-compressing action because the volume within the screw chamber remains the same throughout progress of the screw rotation. Various patents, such as U.S. Pat. No. 3,771,900 to Baehr, show screw-like rotors used as pumping devices. I know of no prior art devices that approximate my design, i.e. a divergent nozzle-like passage structure helically wrapped around a support shaft to perform a motor function.

I wish it to be understood that I do not desire to be limited to the exact details of construction shown and described for obvious modifications will occur to a person skilled in the art.

I claim:

1. A pressurized gas-expansion motor comprising a housing; spaced bearings carried by the housing and operable to define a rotational axis; a pressure-operated rotor comprising a central elongated shaft and two shaft end sections mounted in the spaced bearings for enabling the rotor on the aforementioned rotational axis; said rotor further comprising an outwardly-projecting helical wall extending circumferentially around and along the central elongated shaft for at least four helix convolutions, and an elongated shroud carried on the helical wall in close adjacency to an inner annular surface of the housing; seal means preventing pressurized gas flow through the annular clearance space between the shroud and housing inner surface; said housing having an inlet opening near one end of the annular shroud for receiving pressurized gas, and an outlet opening near the other end of the annular shroud for discharging depressurized gas; the elongated central shaft, helical wall and annular shroud defining an elongated helical gas passage extending circumferentially around and along the central shaft; said shroud having a gas intake port at its inlet end continuously communicating the gas passage with the housing inlet opening; said intake port extending only a limited distance around the shroud circumference; the defined helical gas passage having a progressively increasing cross-sectional area, measured from the inlet end of the shroud to the outlet end, whereby the gas undergoes a continual expansion and depressurization action while it is moving through the gas passage; the length of the helical gas pressure being related to the initial pressure of the gas received through the housing inlet opening, such that the gas exiting through the housing inlet opening is at a relatively low pressure near atmospheric pressure.

2. The motor of claim 1 wherein the annular shroud is a hollow cylinder.

3. The motor of claim 1 wherein the annular shroud is frusto-conical.

* * * * *